United States Patent [19]

York et al.

[11] 4,421,629

[45] Dec. 20, 1983

[54] DELAYED COKING AND DEDUSTING PROCESS

[75] Inventors: Earl D. York, Engelwood, Colo.; Kamil F. Rustam, Naperville; Robert D. Hall, Wheaton, both of Ill.

[73] Assignee: Standard Oil Company (Indiana), Chicago, Ill.

[21] Appl. No.: 271,570

[22] Filed: Jun. 8, 1981

[51] Int. Cl.[3] ..... C10G 1/00; C10B 53/00

[52] U.S. Cl. ..... 208/8 R; 208/11 R

[58] Field of Search ..... 208/8 R, 11 R, 126, 208/127

[56] References Cited

U.S. PATENT DOCUMENTS 3,008,894 11/1961 Culbertson ..... 208/11 R
3,034,979 5/1962 Nevens ..... 208/8 R
3,551,322 12/1970 Clampitt ..... 208/11 R X
4,246,093 1/1981 Wolcott, Jr. ..... 208/8 R

*Primary Examiner*—Patrick Garvin
*Assistant Examiner*—Glenn A. Caldarola
*Attorney, Agent, or Firm*—Thomas W. Tolpin; William T. McClain; William H. Magidson

[57] ABSTRACT

A delayed coking and dedusting process in which dust laden heavy oil derived from solid hydrocarbon-containing material, such as oil shale, coal or tar sand, is preheated in a furnace and thermal cracked in a retort to yield light oils and middle oils. Preferably, steam is injected into the dust laden heavy oil before the dusty oil is heated in the furnace to minimize coking in furnace tubes and furnace outlet lines. The thermal cracked dusty oil leaves a residual dust enriched, coked material that can be combusted to provide a portion of the solid heat carrier material for use in retorting oil shale, coal or tar sand.

20 Claims, 2 Drawing Figures

DELAYED COKING AND DEDUSTING PROCESS

BACKGROUND OF THE INVENTION

This invention relates to a process for retorting solid, hydrocarbon-containing material such as oil shale, coal and tar sand and dedusting and upgrading the effluent product stream.

Researchers have now renewed their efforts to find alternate sources of energy and hydrocarbons in view of recent rapid increases in the price of crude oil and natural gas. Much research has been focused on recovering hydrocarbons from solid hydrocarbon-containing material such as oil shale, coal and tar sand by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah, and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot by recovered by extraction. Upon heating oil shale to a sufficient temperature, the kerogen is thermally decomposed to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, steam and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts in aboveground vessels or in situ retorts underground. In principle, the retorting of shale and other hydrocarbon-containing materials such as coal and tar sand, comprise heating the solid hydrocarbon-containing material to an elevated temperature and recovering the vapors and liberated effluent. However, as medium grade oil shale yields approximately 25 gallons of oil per ton of shale, the expense of materials handling is critical to the economic feasibility of a commercial operation.

In order to obtain high thermal efficiency in retorting, carbonate decomposition should be minimized. Colorado Mahogany zone oil shale contains several carbonate minerals which decompose at or near the usual temperature attained when retorting oil shale. Typically, a 28 gallon per ton oil shale will contain about 23% dolomite (a calcium/magnesium carbonate) and about 16% calcite (calcium carbonate), or about 780 pounds of mixed carbonate minerals per ton. Dolomite requires about 500 BTU per pound and calcite about 700 BTU per pound for decomposition, a requirement that would consume about 8% of the combustible matter of the shale if these minerals were allowed to decompose during retorting. Saline sodium carbonate minerals also occur in the Green River formation in certain areas and at certain stratigraphic zones. The choice of a particular retorting method must therefore take into consideration carbonate decomposition as well as raw and spent materials handling expense, product yield and process requirements.

In surface retorting, oil shale is mined from the ground, brought to the surface, crushed and placed in vessels where it is contacted with a hot heat transfer carrier, such as ceramic or metal balls, hot spent shale or sand for heat transfer. The resulting high temperatures cause shale oil to be liberated from the oil shale leaving a retorted, inorganic material and carbonaceous material such as coke. The carbonaceous material can be burned by contact with oxygen at oxidation temperatures to recover heat and to form a spent oil shale relatively free of carbon. Spent oil shale which has been depleted in carbonaceous material is removed from the reactor and recycled as heat carrier material or discarded. The combustion gases are dedusted in a cyclone or electrostatic precipitator.

Some well-known processes of surface retorting are: N-T-U (Dundas Howes retort), Kiviter (Russian), Petrosix (Brazilian), Lurgi-Ruhrgas (German), Tosco II, Galoter (Russian), Paraho, Koppers-Totzek, Fushum (Manchuria), gas combustion and fluid bed. Process heat requirements for surface retorting processes may be supplied either directly or indirectly.

The Tosco II process and modifications thereof are described in U.S. Pat. Nos. 3,008,894, 3,034,979 and 3,058,903 and at pages 85–88 of the *Synthetic Fuels Data Handbook* by Cameron Engineers, Inc. (Second Edition 1978).

The Lurgi-Ruhrgas process and modifications thereof are described in U.S. Pat. Nos. 3,655,518; 3,703,442; 3,962,043; 4,038,045 and 4,054,492 and in the articles by Marnell, P., entitled *Lurgi/Ruhrgas Shale Oil Process,* published in Hydrocarbon Processing, pages 269–271 (September 1976); Schmalfeld, I. P., *The Use of the Lurgi-Ruhrgas Process for the Distillation of Oil Shale,* Volume 70, Number 3, Quarterly of the Colorado School of Mines, pages 129–145 (July 1975); Rammler, R. W.; *The Retorting of Coal, Oil Shale, and Tar Sand by Means of Circulated Fine-Grained Heat Carriers as a Preliminary Stage in the Production of Synthetic Crude Oil,* Volume 65, Number 4, Quarterly of the Colorado School of Mines, pages 141–167 (October 1970) and at pages 81–85 of the *Synthetic Fuels Data Handbook* by Cameron Engineers, Inc. (Second Edition 1978).

When retorting, thermocracking and coking are carried out simultaneously, carbonaceous residue, also referred to as "coke," "residual carbon" or "carbon residue," is deposited on retorted and heat carrier material and carried along with the effluent product stream. As the effluent product stream and retorted and heat carrier material circulate through various parts of the system at elevated temperatures, coke is deposited along the internal walls of pipes, vessels, cyclones and other equipment. The deposition and buildup of coke in the system restricts the flow rate and throughput capacity of the product stream, as well as the retort and heat carrier material. Coke accumulation also results in the formation of protrusions and depressions on the internal walls of pipes, vessels, cyclones and other equipment which interfere with the smooth linear flow of the effluent product stream as well as the retorted and heat carrier material. Coke deposits can further cause overheating and clog vital parts of equipment resulting in costly shutdown (downtime) and tedious removal of the accumulated carbonaceous residue. Moreover, the accumulation of coke in cyclones impedes dedusting of the effluent product stream. Delayed coking of crude oil and injection of steam to increase the velocity of crude oil and minimize coking are described at pages 131–136 and 145 of the book *Petroleum Processing* by R. J. Hengstebeck, published by McGraw-Hill Book Company, Inc. (1959).

During fluid bed, moving bed and other types of surface retorting, decrepitation of oil shale occurs creating a popcorning effect in which particles of oil shale collide with each other and impinge against the walls of the retort forming substantial quantities of minute entrained particulates of shale dust. The use of hot spent shale or sand as heat carrier material aggravates the dust problem. Rapid retorting is desirable to minimize thermal cracking of valuable condensable hydrocarbons, but increases the rate of decrepitation and amount of dust. Shale dust is also emitted and carried away with the effluent product stream during modified in situ retorting as a flame front passes through a fixed bed of rubblized shale, as well as in fixed bed surface retorting, but dust emission is not as aggravated as in other types of surface retorting.

Shale dust ranges in size from less than 1 micron to 1000 microns and is entrained and carried away with the effluent product stream. Because shale dust is so small, it cannot be effectively removed to commercially acceptable levels by conventional dedusting equipment.

The retorting, carbonization or gasification of coal, peat and lignite and the retorting or extraction of tar sand and gilsonite create similar dust problems.

After retorting, the effluent product stream of liberated hydrocarbons and entrained dust is withdrawn from the retort through overhead lines and subsequently conveyed to a separator, such as a single or multiple stage distillation column, quench tower, scrubbing cooler or condenser, where it is separated into fractions of light gases, light oils, middle oils and heavy oils with the bottom heavy oil fraction containing essentially all of the dust. As much as 40% by weight of the bottom heavy oil fraction consists of dust.

It is very desirable to upgrade the bottom heavy oil into more marketable products, such as light oils and middle oils, but because the heavy oil fraction is laden with dust, it is very viscous and cannot be pipelined. Dust laden heavy oil plugs up hydrotreaters and catalytic crackers, gums up valves, heat exchangers, outlet orifices, pumps and distillation towers, builds up insulative layers on heat exchange surfaces reducing their efficiency and fouls up other equipment. Furthermore, the dusty heavy oil corrodes turbine blades and creates emission problems. If used as a lubricant, dusty heavy oil is about as useful as sand. Moreover, the high nitrogen content in the dusty heavy oil cannot be refined with conventional equipment.

In an effort to solve this dust problem, electrostatic precipitators have been used as well as cyclones located both inside and outside the retort. Electrostatic precipitators and cyclones, however, must be operated at very high temperatures and the product stream must be maintained at or above the highest temperature attained during the retorting process to prevent any condensation and accumulation of dust on processing equipment. Maintaining the effluent steam at high temperatures is not only expensive from an energy standpoint, but it allows detrimental side reactions, such as cracking, coking and polymerization of the effluent product stream, which tends to decrease the yield and quality of condensable hydrocarbons.

Over the years various processes and equipment have been suggested to decrease the dust concentration in the heavy oil fraction and/or upgrade the heavy oil into more marketable light oils and medium oils. Such prior art dedusting processes and equipment have included the use of cyclones, electrostatic precipitators, pebble beds, scrubbers, filters, electric treaters, spiral tubes, ebullated bed catalytic hydrotreaters, desalters, autoclave settling zones, sedimentation, gravity settling, percolation, hydrocloning, magnetic separation, electrical precipitation, stripping and binding, as well as the use of diluents, solvents and chemical additives before centrifuging. Typifying those prior art processes and equipment and related processes and equipment are those found in U.S. Pat. Nos. 2,235,639; 2,717,865; 2,719,114; 2,723,951; 2,793,104; 2,879,224; 2,899,376; 2,904,499; 2,911,349; 2,952,620; 2,982,701; 2,968,603; 3,008,894; 3,034,979; 3,058,903; 3,252,886; 3,255,104; 3,468,789; 3,560,369; 3,684,699; 3,703,442; 3,784,462; 3,799,855; 3,808,120; 3,900,389; 3,901,791; 3,929,625; 3,974,073; 3,990,885; 4,028,222; 4,040,958; 4,049,540; 4,057,490; 4,069,133; 4,080,285; 4,088,567; 4,105,536; 4,151,073; 4,159,949; 4,162,965; 4,166,441; 4,182,672; 4,199,432; 4,220,522 and 4,246,093 as well as in the articles of Rammler, R. W., *The Retorting of Coal, Oil Shale and Tar Sand By Means of Circulated Fine-Grained Heat Carriers as a Preliminary Stage in the Production of Synthetic Crude Oil,* Volume 65, Number 4, Quarterly of the Colorado School of Mines, pages 141–167 (October 1970) and Schmalfeld, I. P., *The Use of The Lurgi/Ruhrgas Process For The Distillation of Oil Shale,* Volume 70, Number 3, Quarterly of the Colorado School of Mines, pages 129–145 (July 1975). These prior art processes and equipment have not been successful in decreasing the dust concentration in the heavy oil fraction to commercially acceptable levels.

It is therefore desirable to provide an improved process, which overcomes most, if not all, of the preceding problems.

SUMMARY OF THE INVENTION

A delayed coking and dedusting process is provided for dedusting and upgrading dust laden heavy oil derived from solid hydrocarbon-containing material, such as oil shale, coal and tar sand. The dedusted and upgraded oil can be safely pipelined through valves, outlet orifices, heat exchangers, pumps, distillation towers and refined in hydrotreaters and catalytic crackers. The novel process reduces dust emissions, decreases dust and coke buildup and diminishes corrosion of equipment.

In the novel process, raw oil shale, coal or tar sand, is fed into a retort, such as a pyrolysis drum, screw conveyor or fluid bed, where it is contacted with hot solid heat carrier material, such as ceramic balls, metal balls, spent shale or sand to liberate an effluent product stream of hydrocarbons and entrained particulates of dust. The effluent product stream is withdrawn from the retort through overhead lines and conveyed to a separator, such as a single or multiple stage quench tower, scrubber, condenser or distillation column, sometimes referred to as a "fractionating column" or "fractionator." Steam can be injected into the retort to minimize the buildup of coke in the overhead lines.

The separator separates the effluent product stream into fractions. Preferably, the temperature of the separator is controlled so that essentially all the dust is entrained in the solids bottom fraction of heavy oil.

In order to dedust and upgrade the dust laden heavy oil fraction, the dust laden heavy oil fraction is fed to a furnace where it is heated. Preferably, the dust laden heavy oil fraction is heated to a temperature slightly less than the retorting temperature to improve thermal efficiency and decrease quantity, rate and temperature requirements of solid heat carrier material. Heating the dust laden fraction before it is fed into the retort also minimizes thermal shock, cracking and fracture of ceramic and metal balls, if ceramic or metal balls are used as the solid heat carrier material. Desirably, steam is injected into the dust laden heavy oil fraction before the dusty heavy oil fraction is fed into the furnace to increase the fraction's velocity through the furnace so as to minimize buildup of carbon residue in the furnace tubes and furnace outlet line. The preheated dust laden heavy oil fraction is then fed into the retort where it is contacted with the hot solid heat carrier material to thermal crack the heavy oil fraction into light and medium oils, leaving a coked residual material having a higher dust concentration.

As used throughout this application, the term "retorted" hydrocarbon-containing material or "retorted" shale refers to hydrocarbon-containing material or oil shale, respectively, which has been retorted to liberate hydrocarbons leaving an organic material containing carbon residue.

The term "spent" hydrocarbon-containing material or "spent" shale as used herein means retorted hydrocarbon-containing material or shale, respectively, from which essentially all of the carbon residue has been removed by combustion.

The term "dust" as used in this application means particulates derived from solid hydrocarbon-containing material and ranging in size from less than one micron to 1000 microns. The particulates can include retorted and raw, unretorted hydrocarbon-containing material, as well as spent hydrocarbon-containing material or sand if the latter is used as solid heat carrier material during retorting.

Dust derived from the retorting of oil shale consists primarily of calcium, magnesium oxides, carbonates, silicates and silicas. Dust derived from the retorting or extraction of tar sand consists primarily of silicates, silicas and carbonates. Dust derived from the retorting, carbonization or gasification of coal consists primarily of char and ash.

The terms "normally liquid," "normally gaseous," "condensable," "condensed," or "noncondensable," are relative to the condition of the subject material at a temperature of 77° F. (25° C.) at atmospheric pressure.

A more detailed explanation of the invention is provided in the following description and appended claims taken in conjunction with the accompanying drawings.

DETAILED DESCRIPTION OF THE PREFERRED EMBODIMENTS

Figure 1:
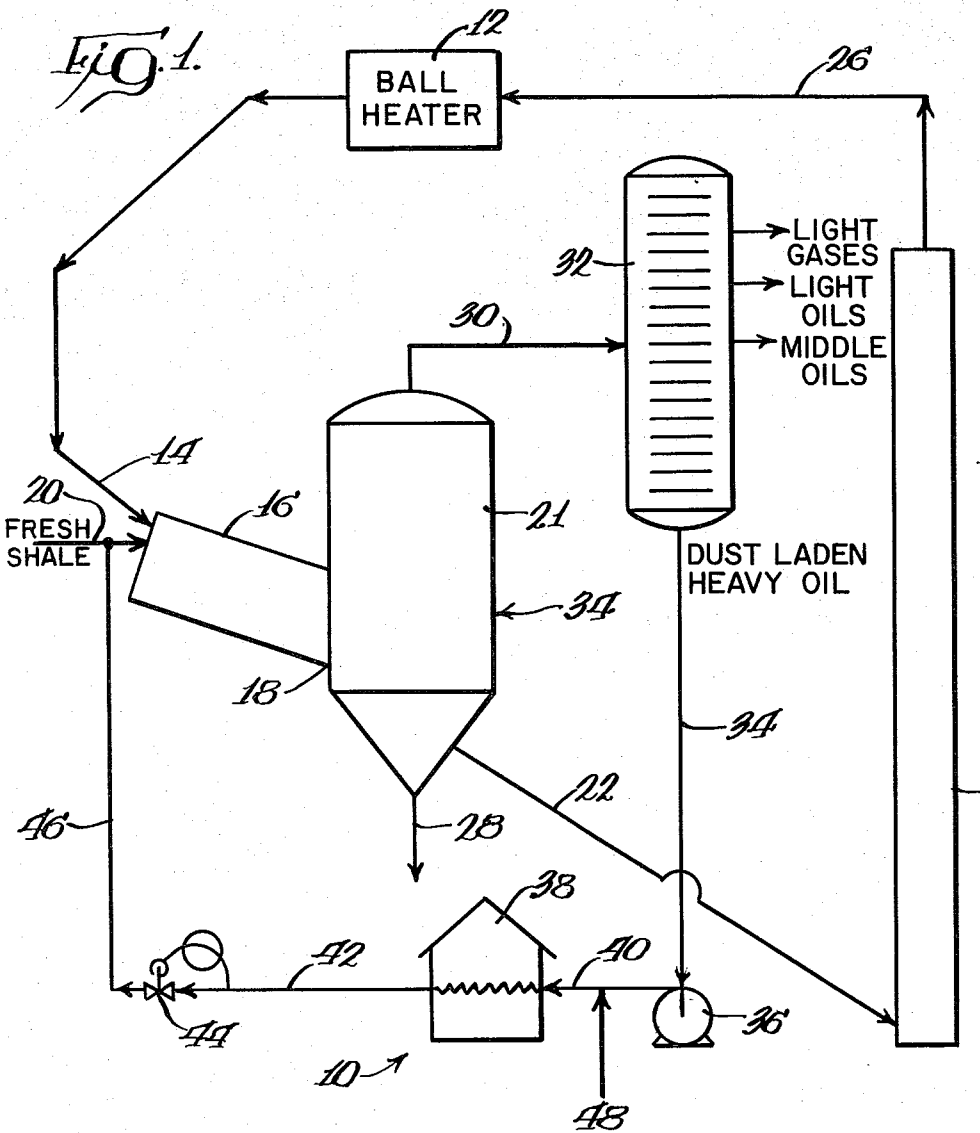
FIG. 1 is a schematic flow diagram of a process in accordance with principles of the present invention.

Referring now to FIG. 1, a delayed coking and dedusting process and system 10 is provided to retort hydrocarbon-containing material, such as oil shale, coal, tar sand, uintaite (gilsonite), lignite, and peat, for use in making synthetic fuels, and to dedust and upgrade the effluent product stream. While the process of the present invention is described hereinafter with particular reference to the processing of oil shale, it will be apparent that the process can also be used to retort other hydrocarbon-containing materials such as coal, tar sand, uintaite (gilsonite), lignite, peat, etc.

In process and system 10, ceramic or metal spherical pebbles or balls, which provide solid heat carrier material, are heated in a ball heater 12 to a temperature from 1000° F. to 1400° F. and preferably between 1200° F. to 1300° F. The balls can be of uniform size or varying sizes and range in diameter from $\frac{3}{8}$ inch to 1 inch. The balls are conveyed through ball line 14 into a rotating pyrolysis drum 16 of a retort 18 to directly contact, heat and retort raw or fresh oil shale.

The raw oil shale which preferably contains an oil yield of at least 15 gallons of shale oil per ton of shale particles, is crushed and sized to a maximum particle size of $\frac{1}{2}$-inch and preheated to a temperature from 550° F. to 600° F. before being fed into pyrolysis drum 16 by feed line 20. The fresh oil shale can be crushed by conventional crushing equipment such as an impact crusher, jaw crusher, gyratory crusher or roll crusher and screened with conventional screening equipment such as a shaker screen or a vibrating screen. Feeding oil shale into pyrolysis drum 16 below 550° F. should be avoided to prevent cracking, fracturing and rupturing of the balls.

Oil shale in pyrolysis drum 16 is heated at atmospheric pressure from 850° F. to 1000° F. and preferably about 890° F. and conveyed by gravity flow to the upright accumulator 21 of retort 18. The balls crush the oil shale to a smaller size. Retorting of the oil shale commences in pyrolysis drum 16 and is completed in accumulator 21.

The balls are discharged from accumulator 21 through ball discharge line 22 where they are fed by gravity flow to a ball elevator or lift elevator 24. Elevator 24 conveys the balls through ball return line 26 to a ball heater 12 where the balls are reheated and recycled back to pyrolysis drum 16.

Retorted oil shale containing inorganic material and carbon residue are discharged from the bottom of accumulator 21 through solids discharge outlet 28. A rotating trommel screen in accumulator 34 directs the balls to ball discharge line 22 and the retorted material to solids discharge outlet 28.

During retorting, an effluent product stream of hydrocarbons are liberated as a gas, vapor, mist, or liquid droplets and most likely a mixture thereof along with entrained particulates of shale dust. The effluent product stream mixed with entrained particulates of shale dust is discharged from the top of accumulator 21 through an overhead line 30 where it is conveyed to a separator 32, such as a quench tower or fractionating column. Steam is injected into accumulator 21 through steam injection line 34 to prevent coking and buildup of carbon residue in overhead line 30. Preferably, superheated steam is injected at a temperature of 500° F. above atmospheric pressure. The steam increases the flow rate and velocity of liberated hydrocarbons passing through overhead line 30.

In separator 32, the effluent product stream is separated into fractions of light gases, light oils, middle oils and heavy oils in a manner well known in the art. From 15% to 35% by weight of the effluent product stream is separated as a solids bottom fraction. The solids bottom fraction, which is sometimes referred to as "dust laden heavy oil" or "dusty heavy oil," is a slurry and consists essentially of normally liquid heavy oil having a boiling point above 600° F. and from 1% to 40% by weight and preferably at least 25% by weight entrained particulates of shale dust. The temperature in fractionator 32 can be varied from 500° F. to 800° F. and preferably to a maximum temperature of 600° F. at atmospheric pressure to assure that essentially all the dust gravitates to the bottoms fraction.

The dust laden heavy oil is removed from the bottom of separator 32 and pumped downward through fractionating discharge line 34 into a furnace 38 via furnace inlet line 40 by pump 36. Pump 36 maintains the inventory in separator 32. The flow rate of dust laden heavy oil from separator 32 should be high enough to prevent the dust laden heavy oil from flooding separator 32 and low enough to prevent cavitation of the separator and damage to the pump.

The heated dust laden heavy oil is discharged through furnace outlet line 42 to a pressure control valve 44. Valve 44 steps down the pressure of the dusty heavy oil to slightly above atmospheric pressure. The reduced pressure oil flows from valve 44 into retort inlet line 46 where it is fed into raw oil shale line 30, so as to be mixed with the raw oil shale, before being recirculated to pyrolysis drum 16. Alternatively, the dust laden heavy oil can be fed directly into pyrolysis drum 16 without first being mixed with the raw oil shale.

Steam is injected through steam injector 48 into the dust laden heavy oil in furnace inlet line 40. The steam increases the velocity of the dust laden heavy oil passing through the furnace tubes and passageways to minimize coking and buildup of carbon residue in the furnace tubes and passageways which would otherwise limit, restrict and/or block the passage of dust laden heavy oil through furnace 38. Preferably, superheated steam is injected into furnace inlet line 40 at a temperature of 500° F. and at a pressure of at least 400 psig.

Furnace 38 heats the dust laden heavy oil to a temperature in the range from 800° F. to slightly below the retorting temperature in pyrolysis drum 16, preferably to 850° F. Preheating the dusty oil before it is fed to pyrolysis drum 16 decreases the temperature gradient (thermal difference) between the hot heat carrier balls and cooler dusty oil when they are mixed in pyrolysis drum 16. A high temperature gradient can cause thermal shock which can crack, fracture and rupture the heat carrier balls.

Preheating the dusty oil in furnace 38 also enhances the thermal efficiency of the system. If the dusty oil were not preheated before being fed into pyrolysis drum 16, greater quantities of heat from the heat carrier balls would be required to heat the dusty oil to the retorting temperature, which would necessitate greater quantities and feed rate of balls or preheating the balls to a much greater temperature. Increasing the quantity and flow rate of balls is not only expensive but decreases shale throughput and retorting efficiency. Increasing the temperature of the balls can cause substantial carbonate decomposition of the oil shale. Therefore, preheating dusty oil in furnace 38, minimizes the amount, rate and temperature of the balls being fed through retort 18.

Furnace 28 is kept at a pressure to maintain the heavy oil in a liquid phase and minimize the vapor phase. The temperature in furnace 38 is kept below the retorting temperature in pyrolysis drum 16 to minimize thermal cracking of the heavy oil in furnace 38 as well as in lines 42, 46 and 20.

The dust laden heavy oil is heated in the pyrolysis drum 16 and accumulator 21 of retort 18 to the retorting temperature when mixed with the hot heat carrier balls to thermal crack and upgrade the heavy oil. From 80% to 100% and preferably at least 90% of the heavy oil in the dust laden heavy oil is thermal cracked into more marketable lighter oils and medium oils. The light and medium oils are withdrawn from accumulator 21 with the effluent product stream through overhead line 30. The thermal cracked heavy oil residue forms a coked material having a higher concentration of dust than the initial solids bottom fraction and contains less than 20% and preferably less than 10% uncracked heavy oil. The residual coked material is removed from accumulator 20 through solids discharge line 28.

Figure 2:
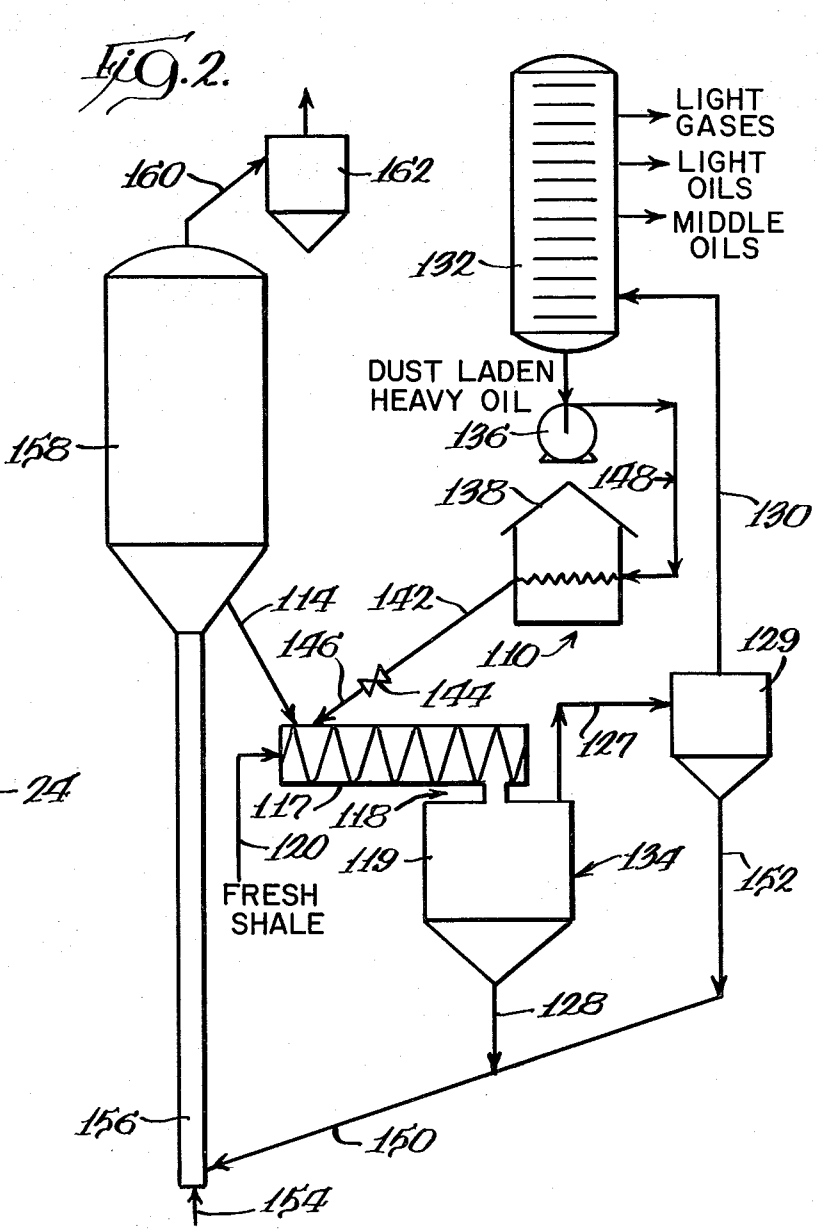
FIG. 2 is a schematic flow diagram of another process in accordance with principles of the present invention.

Referring now to FIG. 2, the process 110 shown in FIG. 2 is similar in many respects to the process 10 shown in FIG. 1. For ease of understanding and for clarity, similar parts and components of process 110 (FIG. 2) have been given part numbers similar to the parts and components of process 10 (FIG. 1) except in the 100 series, such as furnace 138, steam injector 148, etc.

In process 110, a mixture of spent shale and spent residual material provides the solid heat carrier material. Sand can also be used. The heat carrier material is fed through heat carrier line 114 at a temperature from 1000° F. to 1400° F., preferably from 1200° F. to 1300° F., into screw conveyor 117 of retort 118 to mix with, heat and retort raw oil shale in screw conveyor 117.

Raw or fresh oil shale is crushed and sized to a maximum fluidizable size of 10 mm by conventional crushing and screening equipment and fed through fresh shale inlet line 120 into screw conveyor 117 at a temperature from ambient temperature to 600° F.

Screw conveyor 117 mixes the fresh oil shale and solid heat carrier material together and discharges the mixture into surge bin 119 of retort 118. Retorting of the fresh oil shale commences in screw conveyor 117 and is completed in surge bin 119. The retorting temperature of screw conveyor 117 is from 850° F. to 1000° F. and preferably about 960° F. at atmospheric pressure. The solids residence time in screw conveyor 117 is from 6 seconds to 8 seconds. The solids residence time in surge bin 119 is from 5 minutes to 10 minutes.

During retorting, an effluent product stream of hydrocarbons is liberated from the fresh oil shale as a gas, vapor, mist, or liquid droplets and most likely, a mixture thereof, along with entrained particulates of shale dust.

The effluent product stream mixed with entrained particulates of shale dust is removed from surge bin 119 through overhead line 127 and partially dedusted in a cyclone 129 before being fed to separator 132 via separator inlet line 130. Steam from steam injector 134 can also be injected into surge bin 119 to minimize coking and buildup of carbon residue in overhead lines 127 and 130. Separator 132, pump 136, steam injector 148, furnace 138, pressure control valve 144, and lines 140, 142 and 146 operate in the same manner as those components operate in FIG. 1.

Furnace 138 heats the dust laden heavy oil to a temperature from 800° F. to a temperature below the retorting temperature of screw conveyor 117, preferably from 850° F. to 950° F. and most preferably 900° F. While heating the dust laden heavy oil in furnace 138 is not necessary to avoid thermal shock of the solid heat carrier material inasmuch as spent shale is used instead of balls, preheating the dust laden heavy oil in furnace 138 does enhance thermal efficiency and reduce the quantity, rate and temperature of the heat carrier material fed into the retort as explained above.

The dust laden heavy oil is thermal cracked and upgraded in retort 118 by mixing the dusty heavy oil with the solid heat carrier material in screw conveyor 117 and surge bin 119. The product yield and recovery are similar to the process of FIG. 1.

The residual coked material, retorted shale and heat carrier material are removed from surge bin 119 through solids discharge outlet 128 and conveyed by gravity flow through combustor inlet line 150 into a vertical combustion lift pipe 156. Dust removed by cyclone 129 is discharged through cyclone discharge line 152 and also fed into combustor inlet line 150.

Air is injected through air injector 154 into the bottom of lift pipe 156 to fluidize, entrain, mix, propel and convey the residual coked material, retorted shale, heat carrier material and cyclone dust, upwardly to a collection and separating bin 158, also referred to as a "collector." Carbon residue contained in the coked residual material and in the retorted shale is combusted in lift pipe 156 at a temperature from 1000° F. to 1400° F. and preferably from 1200° F. to 1300° F. leaving spent residual material and spent shale, respectively, which are recycled into retort 118 via heat carrier line 114 with the reheated spent shale as solid heat carrier material. The combustion gases and products of combustion are removed through an overhead outlet line 160 and dedusted in cyclone 162 before being discharged.

While the delayed coking and heavy oil dedusting process of this invention is particularly useful with the retorts described above, it can also be used with other retorts such as fluid bed retorts. The delayed coking and dedusting process can also be used to remove particulates of dust from whole oil at somewhat higher pressures.

Among the many advantages of the process of this invention are:

1. Improved quality and quantity of product yield.
2. Less coking of lines.
3. Better dedusting of the bottom heavy oil fraction.
4. Lower product viscosity.
5. Upgrading and purification of heavy oil.
6. Ability to pipeline the dedusted oil through valves, outlet orifices, heat exchangers, pumps and distillation towers and refine the dedusted oil in hydrotreaters and catalytic crackers.
7. Decreased erosion of equipment.
8. Less wastage.
9. Reduced downtime.

Although embodiments of this invention have been shown and described, it is to be understood that various modifications and substitutions, as well as rearrangements or combinations of process steps, can be made by those skilled in the art without departing from the novel spirit and scope of this invention.

What is claimed is:

1. A process for use in making synthetic fuels, comprising the steps of:

introducing said hydrocarbon-containing material into a retort;

introducing solid heat carrier material into said retort;

retorting said solid hydrocarbon-containing material by contacting said solid hydrocarbon-containing material with said solid heat carrier material at a sufficient retorting temperature in said retort to liberate an effluent product stream of hydrocarbons containing entrained particulates derived from said solid hydrocarbon-containing material;

separating a dust laden oil fraction containing normally liquid oil and a substantial portion of said entrained particulates from said effluent product stream;

pumping said dust laden oil fraction through a furnace, via a furnace inlet line and a furnace outlet line;

substantially minimizing coking and buildup of carbon in said furnace and said furnace outlet line by injecting steam into said dust laden oil fraction in said furnace inlet line in a sufficient amount to increase the velocity of said dust laden oil fraction through said furnace without substantially stripping said hydrocarbons from said dust laden oil fraction;

substantially minimizing the amount, rate and temperature of solid heat carrier material being introduced into said retort by heating said dust laden oil fraction at a pressure to minimize vaporization of said normally liquid oil in said furnace and at a temperature ranging from 800° F. to less than the retorting temperature in said retort, after said steam has been injected into said dust laden oil fraction;

feeding all of said dust laden oil fraction to said retort after said dust laden oil fraction has been heated in said furnace; and thereafter, thermal cracking said dust laden oil fraction in said retort by contacting said entire dust laden oil fraction with said solid heat carrier material in said retort to liberate lighter hydrocarbons from said oil fraction and form a coked residual material having a greater concentration of said particulates than said dust laden oil fraction.

2. A process in accordance with claim 1 wherein:

said hydrocarbon-containing material is selected from the group consisting of oil shale, tar sands, coal, lignite, peat and uintaite;

said heat carrier material is selected from the group consisting of combusted coked material, combusted retorted material, sand, ceramic balls and metal balls; and said normally liquid oil is selected from the group consisting of heavy oil and whole oil.

3. A process in accordance with claim 2 wherein said particulates are selected from the group consisting of calcium, magnesium oxides, carbonates, silicates, silicas, char and ash and said particulates range in size from slightly less than one micron to 1000 microns.

4. A process in accordance with claim 1 wherein said retort includes a pyrolysis drum.

5. A process in accordance with claim 1 wherein said retort includes a screw conveyor.

6. A process in accordance with claim 1 wherein said retort includes a fluidized bed.

7. A process in accordance with claim 1 wherein 80% to 100% of said normally liquid oil in said dust laden oil fraction is thermal cracked to lighter hydrocarbons in said retort.

8. A process in accordance with claim 7 wherein at least 90% of said normally liquid oil in said dust laden oil fraction is thermal cracked to lighter hydrocarbons in said retort.

9. A process in accordance with claim 1 wherein said coked material is removed from said retort and combusted and said combusted coked material is fed into said retort to provide at least a portion of said heat carrier.

10. A process in accordance with claim 1 wherein said dust laden oil fraction is heated in said furnace to a temperature from 850° F. to 950° F. and the pressure of said heated dust laden oil fraction is decreased to about atmospheric pressure before said heated dust laden oil fraction is fed into said retort.

11. A process for use in making synthetic fuels, comprising the steps of:

(a) feeding raw oil shale at a temperature from about 550° F. to 600° F. into a retort having a rotating pyrolysis drum and an accumulator;

(b) feeding solid heat carrier material selected from the group consisting of ceramic balls and metal balls at a temperature from 1000° F. to 1400° F. into said retort;

(c) retorting said raw oil shale by contacting said oil shale with said solid heat carrier material in said retort at a retorting temperature from 850° F. to 1000° F. to liberate an effluent product stream of hydrocarbons and entrained particulates of shale dust ranging in size from slightly less than one micron to 1000 microns;

(d) separating 15% to 35% by weight of said effluent product stream into a dust laden heavy oil fraction consisting essentially of normally liquid heavy oil having a boiling point above 600° F. and from 1% to 40% by weight entrained particulates of said shale dust;

(e) minimizing deposition of coke along furnace passageway of a furnace by injecting steam into said dust laden heavy oil fraction in a sufficient amount to enhance the velocity of said dust laden heavy oil fraction through said furnace;

(f) feeding said dust laden heavy oil fraction into said furnace after said steam has been injected into said dust laden heavy oil fraction;

(g) heating said dust laden heavy oil fraction at a pressure to minimize vaporization of said normally liquid heavy oil in said furnace and at a temperature in the range from 800° F. to slightly less than said retorting temperature after said steam has been injected into said dust laden heavy oil fraction, to substantially prevent thermal fracturing of said balls during step (i) and to enhance efficiency of step (i).

(h) feeding all of said dust laden heavy oil fraction into said rotating pyrolysis drum concurrently with steps (a) and (b) after said dust laden heavy oil fraction has been heated in said furnace; and (i) thermal cracking said heated dust laden heavy oil fraction in said rotating pyrolysis drum by contacting all of said dust laden heavy oil fraction with said solid heat carrier material at said retorting temperature concurrently with step (c) to liberate lighter hydrocarbons from said dust laden heavy oil fraction and form a coked residual material having a greater concentration of said shale dust than said dust laden heavy oil fraction.

12. A process in accordance with claim 12 wherein:

said effluent product stream contains at least 25% by weight particulates of said shale oil dust;

said effluent product stream is removed from said accumulator through an overhead line;

steam is injected into said accumulator to minimize coking of said overhead line; and said effluent product stream is separated in a fractionating column.

13. A process in accordance with claim 12 wherein said dust laden heavy oil fraction is heated to about 850° F. in said furnace and the pressure of said heated dust laden heavy oil fraction is decreased to about atmospheric pressure before step (i)

14. A process in accordance with claim 12 wherein said heated dust laden heavy oil fraction is fed into said rotating pyrolysis drum separately from said raw oil shale to substantially prevent said heated dust laden heavy oil fraction from contacting said raw oil shale before entering said rotating pyrolysis drum.

15. A process for use in making synthetic fuel, comprising the steps of:

(a) feeding raw oil shale at a temperature from ambient temperature to 600° F. into a screw conveyor retort;

(b) feeding substantially combusted, fully spent oil shale at a temperature from 1000° F. to 1400° F. into said screw conveyor retort concurrently with step (a);

(c) feeding substantially combusted, fully spent coked material at a temperature from 1000° F. to 1400° F. into said screw conveyor retort concurrently with steps (a) and (b);

(d) heating said raw oil shale to a retorting temperature from 850° F. to 1000° F. by mixing said raw oil shale, spent oil shale and spent coked material together in said screw conveyor retort at about atmospheric pressure to liberate an effluent product stream of hydrocarbons and entrained shale particulates ranging in size from slightly less than one micron to 1000 microns, and discharging said mixture and effluent product stream into a surge bin;

(e) separating 15% to 35% by weight of said effluent product stream into a dust laden heavy oil fraction consisting essentially of normally liquid heavy oil having a boiling point above 600° F. and a maximum of 40% by weight of said entrained shale particulates;

(f) injecting a sufficient amount of steam into said dust laden heavy oil fraction to enhance the velocity of said dust laden heavy oil fraction through a furnace to substantially minimize the deposition of coke in passageways of said furnace;

(g) pumping said dust laden heavy oil fraction through said furnace;

(h) substantially minimizing the quantity, rate and temperature of spent shale being fed to said retort by heating said dust laden heavy oil fraction in said furnace to a temperature in the range from 800° F. to slightly less than the retorting temperature in the screw conveyor retort after said steam has been injected into said dust laden heavy oil fraction;

(i) decreasing the pressure of said heated dust laden heavy oil fraction to about atmospheric pressure;

(j) feeding said entire dust laden heavy oil fraction into said screw conveyor retort concurrently with steps (a), (b) and (c) after step (i);

(k) mixing all of said dust laden heavy oil fraction with said spent oil shale and said spent coked material in said screw conveyor retort at said retorting temperature concurrently with step (d) to thermal crack from 80% to 100% by weight of said normally liquid heavy oil in said dust laden heavy oil fraction into lighter hydrocarbons and form a coked material containing a maximum of 20% by weight normally liquid heavy oil, carbon residue and a greater concentration by weight of said shale particulates than said dust laden heavy oil fraction obtained from step (e), and discharging said mixture and said coked material into said surge bin;

(l) removing said coked material and said retorted shale, together with said spent coked material and said spent shale, from said surge bin;

(m) feeding said removed material to a lift pipe; and (n) injecting air into said lift pipe to substantially combust said coked material and said retorted material and fluidize, entrain, and propel said removed material upwardly through said lift pipe to a separation bin to heat the removed material and form spent coked material for step (c) and spent oil shale for step (b).

16. A process in accordance with claim 15 wherein:

step (f) includes injecting superheated steam at a pressure of at least 400 psig and at a temperature of about 500° F. into said dust laden heavy oil fraction;

said retorting temperature is about 960° F.;

the temperature of said spent shale in step (b) is from 120° F. to 1300° F.;

the temperature of said spent coked material in step (c) is from 1200° F. to 1300° F.;

the solids residence time in said screw conveyor is from 6 seconds to 8 seconds;

the solids residence time in said surge bin is from 5 minutes to 10 minutes; and said dust laden heavy oil fraction is heated in said furnace to a temperature ranging from 850° F. to 950° F.

17. A process in accordance with claim 15 wherein said dust laden heavy oil fraction contains at least 25% by weight of said particulates, said particulates include raw, retorted and spent oil shale, and at least 90% of said normally liquid heavy oil in said dust laden heavy oil fraction is thermal cracked to lighter hydrocarbons in step (k).

18. A process in accordance with claim 15 wherein said effluent product stream is separated in a fractionating column into said dust laden heavy oil fraction.

19. A process in accordance with claim 15 wherein said effluent product stream is separated in a quench tower into said dust laden heavy oil fraction.

20. A process in accordance with claim 15 wherein:

said dust laden heavy oil fraction is heated in said furnace to about 900° F. after said steam is injected into said dust laden heavy oil fraction;

coking of said dust laden heavy oil fraction commences in said furnace and is substantially completed in said surge bin; and said spent oil shale and said spent coked material are mixed together and fed through a common line into said screw conveyor retort.

* * * * *

UNITED STATES PATENT OFFICE

CERTIFICATE OF CORRECTION

Patent No. 4,421,629 Dated December 20, 1983

Inventor(s) YORK, EARL D. - RUSTAM, KAMIL F. - HALL, ROBERT D.

It is certified that error appears in the above-identified patent and that said Letters Patent are hereby corrected as shown below:

| Column | Line | |
|---|---|---|
| 1 | 38 | "by" (1st occurrence) should be --be-- |
| 2 | 55 | delete ";" and insert --,-- |
| 10 | 12 | "said" should be -- solid -- |
| 14 | 5 | "120°F" should be -- 1200°F -- |

Signed and Sealed this

*Fifteenth* Day of *May 1984*

[SEAL]

*Attest:*

GERALD J. MOSSINGHOFF

*Attesting Officer*

*Commissioner of Patents and Trademarks*